US005317239A

United States Patent [19]

Ohguro et al.

[11] Patent Number: 5,317,239

[45] Date of Patent: May 31, 1994

[54] DEFLECTION YOKE FOR CATHODE RAY TUBE

[75] Inventors: Hiroki Ohguro, Kanagawa; Yoshio Yoshiwara, Chiba; Minoru Furuya, Iwate; Nobutaka Okuyama, Kanagawa; Soichi Sakurai, Kanagawa; Michitaka Ohsawa, Kanagawa, all of Japan

[73] Assignees: Hitachi, Ltd., Tokyo; Hitachi Mizusawa Electronics Co., Ltd., Mizusawa, both of Japan

[21] Appl. No.: 5,147

[22] Filed: Jan. 15, 1993

[30] Foreign Application Priority Data

Jan. 17, 1992 [JP] Japan ..... 4-006195

[51] Int. Cl.[5] ..... H01J 29/56

[52] U.S. Cl. ..... 315/370; 315/8

[58] Field of Search ..... 315/370, 8

[56] References Cited

U.S. PATENT DOCUMENTS 4,853,588 8/1989 Ohtsu et al. ..... 315/8

5,049,847 9/1991 Okuyama et al. ..... 315/8

*Primary Examiner*—Theodore M. Blum

*Attorney, Agent, or Firm*—Antonelli, Terry, Stout & Kraus

[57] ABSTRACT

A deflection yoke having cancelling loop coils for reducing undesired portions of a horizontal deflection magnetic field generated by a deflection yoke body without mislanding. The cancelling loop coils generate a cancelling magnetic field which includes two peaks in a front region and a rear region of the deflection yoke body in which the undesired field portions exist, respectively. The peaks are opposite in direction to the horizontal magnetic field generated by the deflection yoke body, respectively, with same ratio to the deflection magnetic field, so that the undesired magnetic field portions are under-corrected in the front portion and over-corrected in the rear portion.

4 Claims, 9 Drawing Sheets

FIG. 6(a) LEAK MAGNETIC FIELD
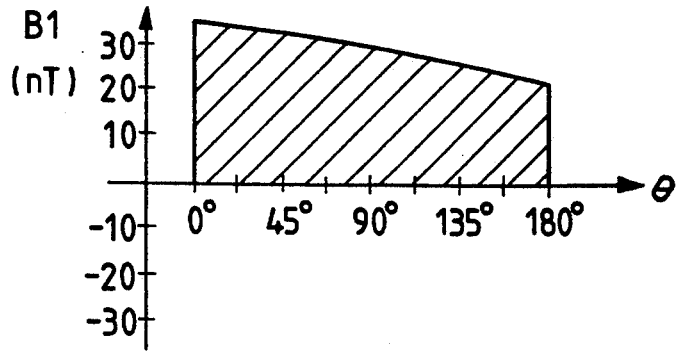
FIG. 6(b) CANCELLING MAGNETIC FIELD
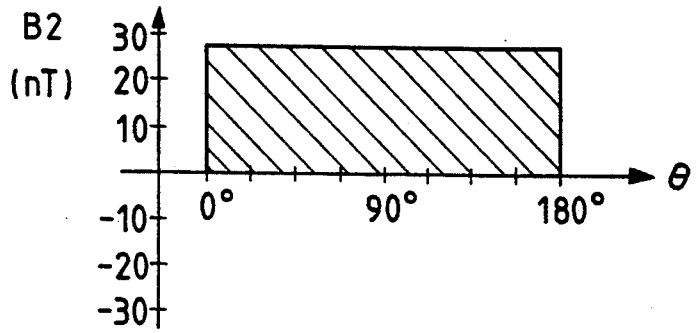
FIG. 6(c) CORRECTED MAGNETIC FIELD
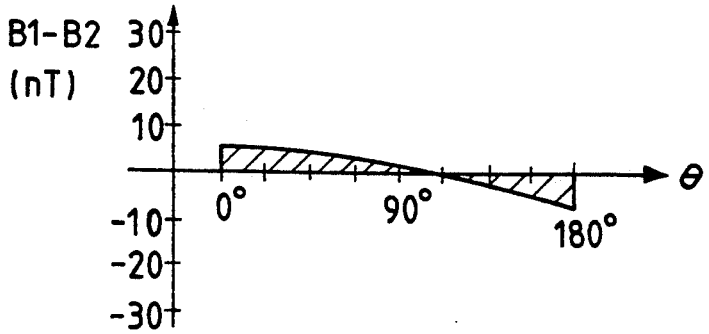

MEASURING POINT

AMOUNT OF UNDESIRED FIELD

DEFLECTION YOKE FOR CATHODE RAY TUBE

BACKGROUND OF THE INVENTION

The present invention relates to a deflection yoke to be used with a cathode ray tube of a display device and, particularly, to a deflection yoke having a canceler coil for cancelling undesired magnetic field radiation produced by the deflection yoke around the display device It is a recent tendency to restrict undesired magnetic radiation around a display device to a level not higher than a predetermined value. Among others, in the extremely low frequency (ELF) band covering a frequency range from 5 Hz to 2 kHz and the very low frequency (VLF) band covering a frequency range from 2 kHz to 400 kHz, such undesired magnetic field comprises a portion of magnetic field generated by a deflection yoke mounted on a cathode ray tube, as a leak magnetic field. Particularly, a special procedure is necessary to reduce an amount of magnetic flux leakage in the VLF band since the frequency range covered thereby may provide adverse effect on human body.

Various methods have proposed for suppressing such leak field which use correction coils and are disclosed in, for example, IBM Technical Disclosure Bulletin, Vol. 31, No. Jun. 1, 1988, pp 119 to 122, U.S. Pat. No. 4,922,167 in which two pairs of coils are used, Japanese Kokai 2-123647 corresponding to Italian application No. 22475 A/88, and U.S. Pat. No. 5,049,847 in which two pairs of coils are used.

These prior arts disclose the use of cancelling coils on the deflection yoke for cancelling the magnetic flux leakage.

FIG. 7 shows schematically a typical example of a conventional cancelling coil system for cancelling undesired magnetic field radiation, which is disclosed in Japanese Kokai No. 2-46085 corresponding to European application No. 88305986.7

As shown by solid arrows in FIG. 7, a leakage magnetic field 7 from a deflection yoke 9 exists in front and rear regions 12 of a display device. A pair of loop coils 4 forming a cancelling coil are arranged above and below a front end portion of the deflection yoke 9, respectively, with certain angles with respect to an axis (Z) of a cathode ray tube 10. By supplying horizontal deflection currents to the loop coils 4, a magnetic field 6 opposite in direction to the undesired leakage field 7 from the deflection yoke 9 is generated by the loop coils 4 as shown by dotted lines.

With such conventional cancelling coil system for leak magnetic field in the front and rear regions of the display device, it is unavoidable that portions of a required deflection magnetic field in the vicinity of the deflection yoke are also cancelled out. In such case a, locus of an electron beam passing through the deflection field is varied thereby, causing performances of the deflection yoke to be degraded. One of the performances of the deflection yoke which are influenced by such undesired cancellation of required magnetic field is the so-called "mislanding" or "purity-offset". This is caused by deviation of the deflection center of the electron beam under influence of the cancelling magnetic field.

FIG. 8 shows a distribution of undesired leak magnetic field radiation around the display device, which is caused by the deflection yoke, in which FIG. 8(*a*) shows points which are set on a circle having the cathode ray tube 10 as a center in a horizontal plane (Y=0) containing the axis (Z) of the cathode ray tube 10 and radius of a half of the full length of the cathode ray tube plus 50 cm and at which magnetic field strength are measured, the points being angularly separated from each other by 22.5°, and FIG. 8(*b*) shows leak magnetic field strength measured at the respective points in polar-coordinates.

Due to the structure of the deflection yoke 9, the field strength of undesired magnetic radiation measured in a front region of the cathode ray tube 10 is larger than that measured at a rear region. Therefore, it is necessary to make an amount of cancelling magnetic field in the front region of the tube larger than that in the rear region of the tube. For this reason, the loop coils of conventional cancelling coil disclosed in such as Japanese Kokai No. 2-46085 are arranged in backwardly opened relation to each other to regulate correction ratio of the front region to the rear region.

FIGS. 9 and 10 show vector diagrams of the deflection magnetic field 7 generated by the horizontal deflection coils 2 and the cancelling magnetic field 6 generated by the cancelling coils 4 in a region in which electron beams are to be deflected, respectively, with only an upper half of the deflection yoke being illustrated in cross section taken in a plane including the axis (Z) of the cathode ray tube.

In FIG. 9, it is clear that, within and in a front and a rear regions of the deflection yoke, the deflection magnetic field 7 generated is upward generally. In FIG. 10, it is clear that the conventional, inclined loop coils 4 mounted above and below the front end portion of the deflection yoke generate a downward cancelling magnetic field in the front and the rear regions of the deflection yoke, which is opposite to the deflection field.

FIG. 11 shows distributions of the deflecting field and the cancelling field 6 shown in FIGS. 9 and 10 measured on the center axis of the deflection yoke (Z axis), with ordinates being plus for positive direction of the Y axis. In FIG. 11, the deflecting field 7 is normalized with its peak value and scaled on the right side ordinate The cancelling field 6 is indicated in absolute value on the left side ordinate. In FIG. 11, relative positions of a ferrite core of the deflection coil, the horizontal deflection coil and the cancelling coil are shown by lines 1, 2 and 4, respectively. As shown by the curve 6 in FIG. 11, the loop coils 4 generate a magnetic field in the same direction as that generated by the horizontal deflection coil 2 within the region defined by the latter. However, the direction of the cancelling field 6 is opposite thereto in the front and rear regions of the horizontal deflection coil 2. As will be clear from FIG. 11, the center of the deflection field 7 after corrected by the cancelling field 6 is deviated backwardly since the cancelling field strength in the front region is larger than that in the rear region. Such backward deviation of the deflection center causes an electron beam to misland on a screen of the cathode ray tube.

The principle of generation of the mislanding is illustrated schematically in FIG. 12. Electron beam path is changed from a path 14 to a path 13 under influence of the cancelling field and, when the deflection center 20 is shifted rearwardly by ΔZ, an incident angle of the electron beam onto a shadow mask 18 is reduced, so that the electron beam strikes fluorescent material on the screen 17 of the cathode ray tube at a position shifted inwardly of the screen 17 toward the center by ΔX. This is the phenonenon called mislanding. For a 14-inch cathode ray tube, when a cancelling coil having no core is used, the shift ΔX becomes about 10 μm or, when the cancelling coil has a magnetic core, the shift becomes about 20 μm.

Due to this mislanding, the shadow mask has to be modified again.

SUMMARY OF THE INVENTION

An object of the present invention is to provide a deflection yoke for use in a cathode ray tube, which is free from undesirable effect of a cancelling field for cancelling leak magnetic field from a deflection coil.

Another object of the present invention is to provide an arrangement of a cancelling field generating device which is effective to make a cancelling field distribution suitable for cancelling leak magnetic field without causing mislanding of electron beam.

A deflection yoke for use in a display device, according to the present invention, comprises a deflection yoke including horizontal deflection coils, vertical deflection coils and ferrite cores, for generating a deflection magnetic field for scanning an electron beam in a horizontal and a vertical directions, and a cancelling coil including an upper loop coil and a lower loop coil which are mounted above and below a front end portion of the deflection yoke for generating a cancelling magnetic field for cancelling undesired magnetic field radiation generated by the deflection yoke around the display device, wherein the upper and lower loop coils are supplied with a horizontal deflection current such that they generate the cancelling magnetic field whose amount in a front region and a rear region with respect to a center of electron beam of the horizontal deflection coil on an axis of the cathode ray tube of the display device are made substantially equal.

Each of the loop coils is arranged, in the axis (Z axis) direction of the tube, within a region from a front end portion of the horizontal deflection coil to a center of the ferrite core. Sizes of each loop coil in horizontal (X axis) and vertical (Y axis) directions are arbitrary. The upper and the lower loop coils are mounted outwardly of the horizontal deflection coils in parallel to the center axis (Z axis) of the deflection yoke equidistantly therefrom, respectively.

According to the present invention, the cancelling field generated by the cancelling coil in the front region and the rear region of the center of the deflection field is opposite in direction to the deflection field and substantially equal in field strength. Therefore, the leak field (a portion of the deflection field) around the display device is cancelled out by a substantially equal amount in the front and rear regions of the deflection center. Consequently, the deviation of deflection center can be reduced to a very small value with which the problem of mislanding becomes negligible.

BRIEF DESCRIPTION OF THE DRAWINGS

The above-mentioned and other objects, features and advantages of the present invention will become more apparent by reference to the following detailed description of the present invention taken in conjunction with the accompanying drawings, wherein:

FIGS. 6(*a*)-6(*c*) show graphs for explanation of leak magnetic field and cancelling magnetic field in the embodiment of the present invention;

DETAILED DESCRIPTION OF THE PREFERRED EMBODIMENTS

An embodiment of the present invention will be described with reference to FIGS. 1 to 6.

Figure 1:
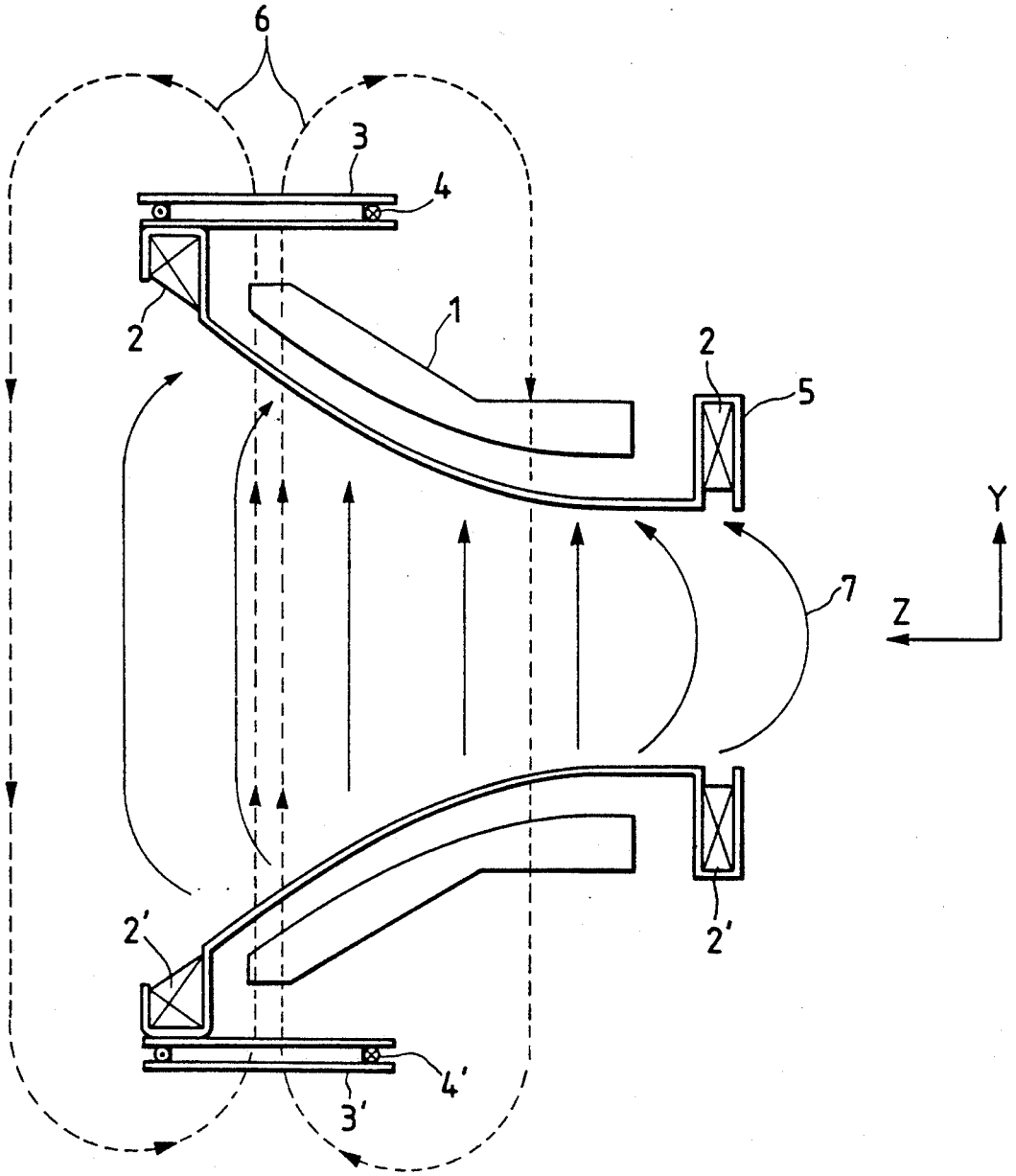
FIG. 1 is a cross section of a main portion of a deflection yoke according to an embodiment of the present invention.
Figure 2:
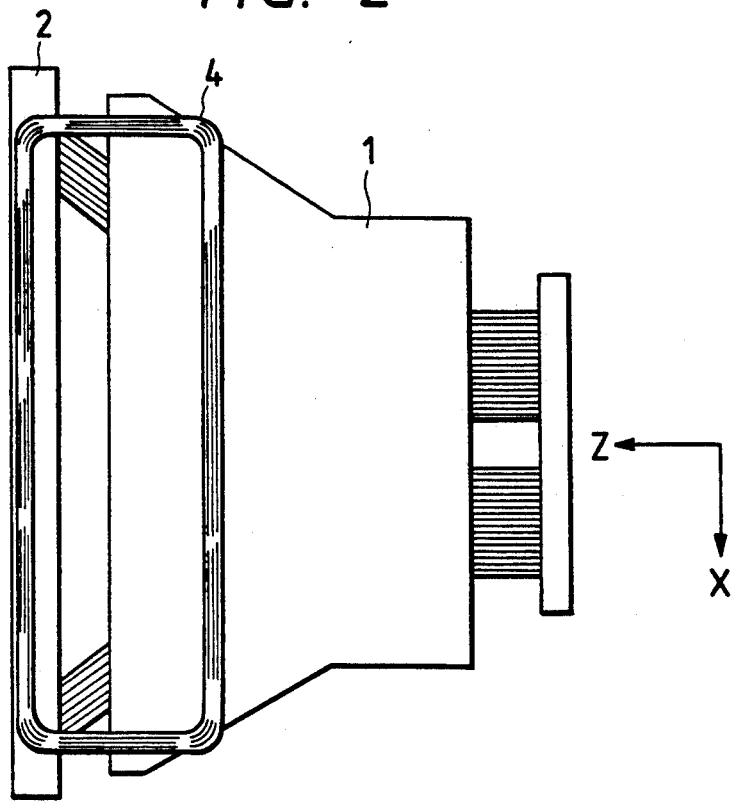
FIG. 2 is a plan view of the deflection yoke shown in FIG. 1.

FIG. 1 is a longitudinal cross section of a deflection yoke according to an embodiment of the present invention taken along an axis of a cathode ray tube not shown and FIG. 2 is a plan view of the embodiment shown in FIG. 1.

The deflection yoke itself shown in FIGS. 1 and 2 comprises saddle type horizontal deflection coils 2 and 2' and supported by a separator 5, vertical deflection coils (not shown) and a ferrite core 1 which are arranged in the order. The horizontal deflection coils 2 and 2' generate horizontal deflection magnetic field 7 in a region defined a therebetween. The horizontal deflection field 7 distributes in not only the region defined by the horizontal deflection coils 2 and 2' but also outside thereof as a leak field.

Cancelling loop coils 4 and 4, are mounted above and below a front end portion of the horizontal deflection coils 2 and 2', respectively, through the separators 5, as shown. The loop coils 4 and 4' are wound on bobbins 3 and 3' and cover a region extending from the front end of the deflection yoke to a position slightly before a center of the ferrite core 1 in the Z direction. Each bobbin is narrower in width than a maximum horizontal diameter of the deflection yoke in X direction. The mounting angle of the loop coils with respect to an axis (Z) of the cathode ray tube is zero. That is, the loop coils 4 and 4' are mounted on the separators 5 in parallel to the axis of the tube, respectively.

A horizontal deflection current is also supplied to the loop coils 4 and 4'. The loop coils 4 and 4' are wound such that they generate a cancelling magnetic field 6 whose direction is opposite to the horizontal deflection magnetic field 7 in the front and rear regions of the deflection yoke. The mounting positions of the loop coils 4 and 4' in Z direction are selected such that a deflection center provided by themselves coincides with the deflection center of the deflection field.

A relation between the loop coils 4 and 4' and the deflection center of the deflection coils will be described.

Figure 3:
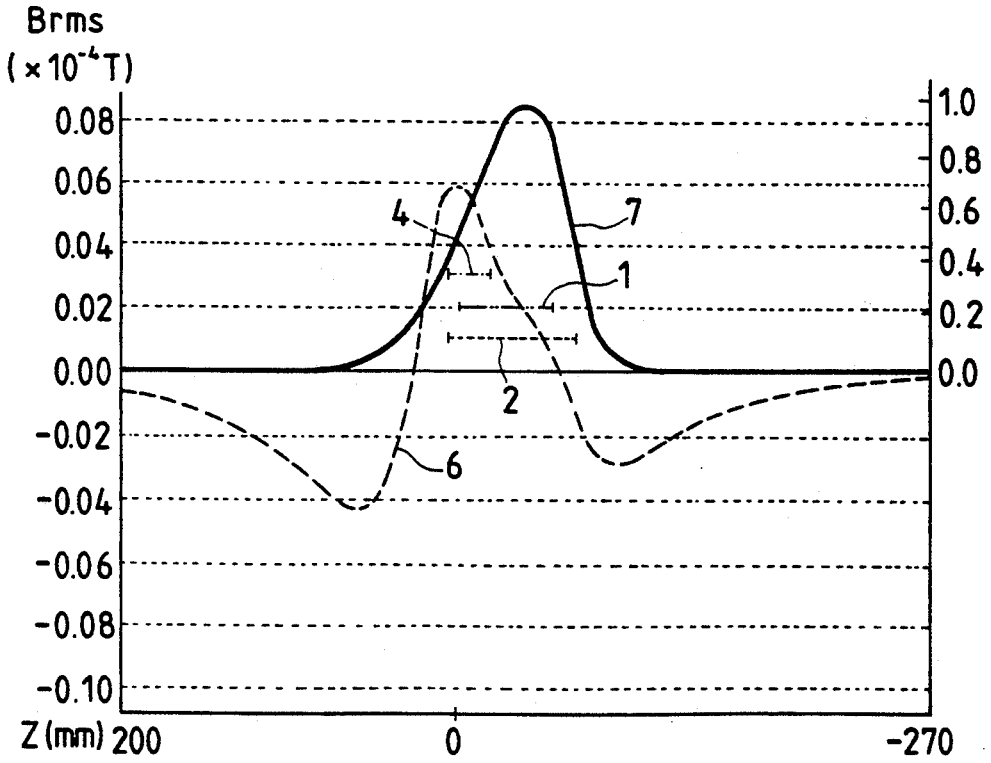
FIG. 3 is a graph showing distributions of a deflection field and a cancelling field on a center axis of the deflection yoke shown in FIG. 1.
Figure 11:
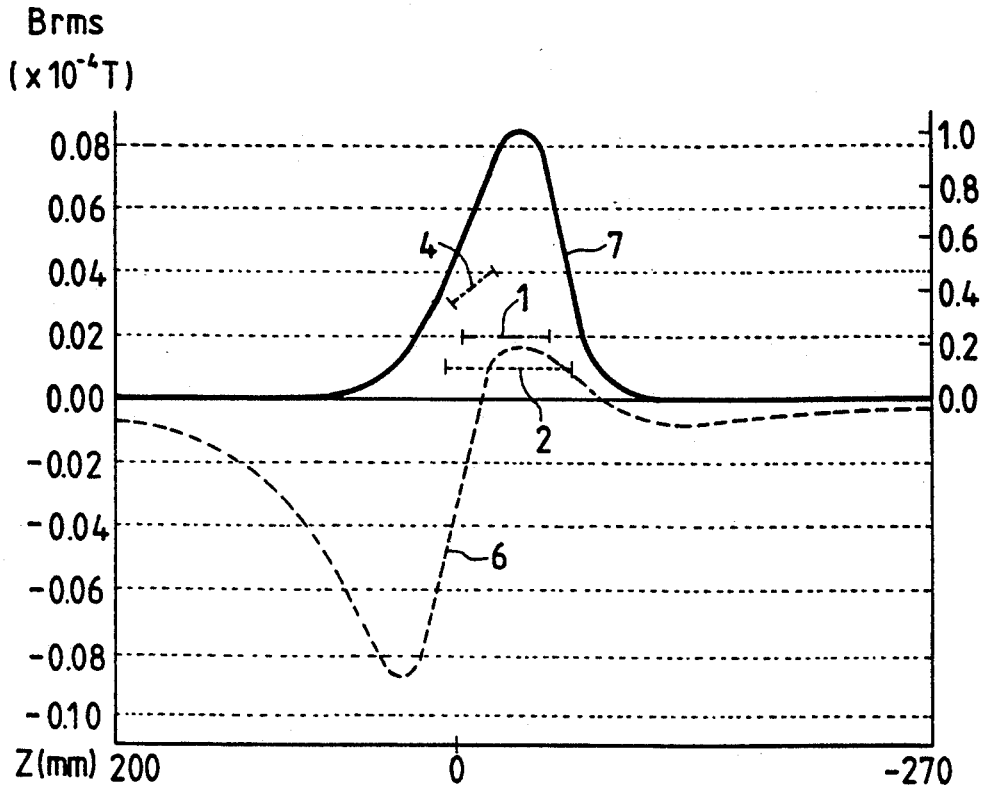
FIG. 11 is a graph showing a magnetic field distribution on an axis of a conventional deflection yoke.
Figure 12:
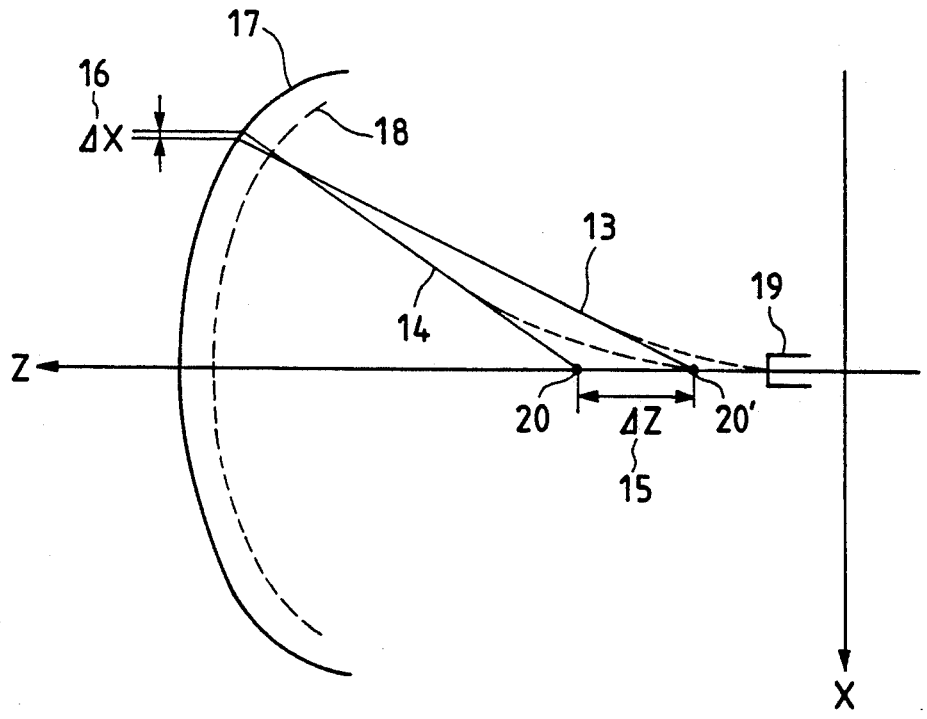
FIG. 12 illustrates a mislanding due to deviation of deflection center.

FIG. 3 is similar to FIG. 11, showing a deflection field 7 and a cancelling field 6 generated by an embodiment of the loop coils 4 and 4' according to the present invention. As shown, the cancelling field 6 includes two peaks which are opposite in direction to the deflection field 7 in the front and rear regions of the deflection yoke with ratio thereof to the deflection field being substantially the same, respectively. That is, in FIG. 3, the peak in the front region is about −0.0425 and the peak in the rear region is about −0.03 such that the ratio of the peaks of −0.03/−0.0425 is within a different of about 30%.

Figure 4A:
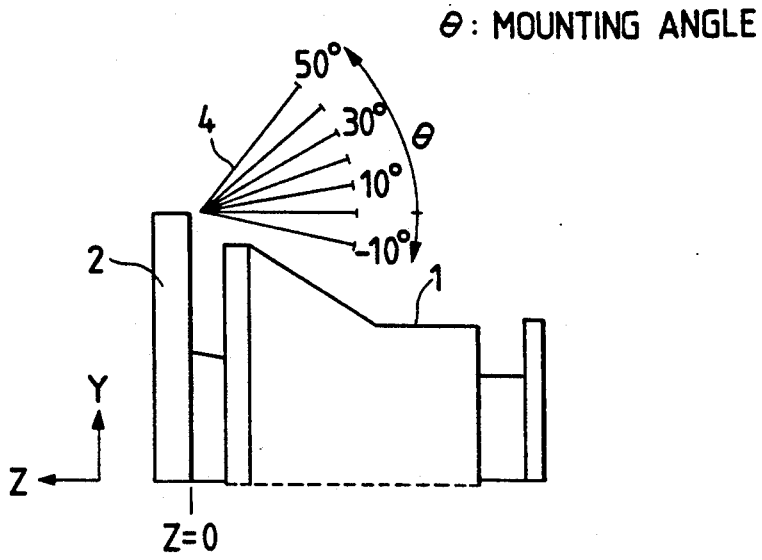
FIGS. 4(*a*) and 4(*b*) show a relation between the distribution of the cancelling field and a mounting angle of the cancelling coil on a cathode ray tube.
Figure 4B:
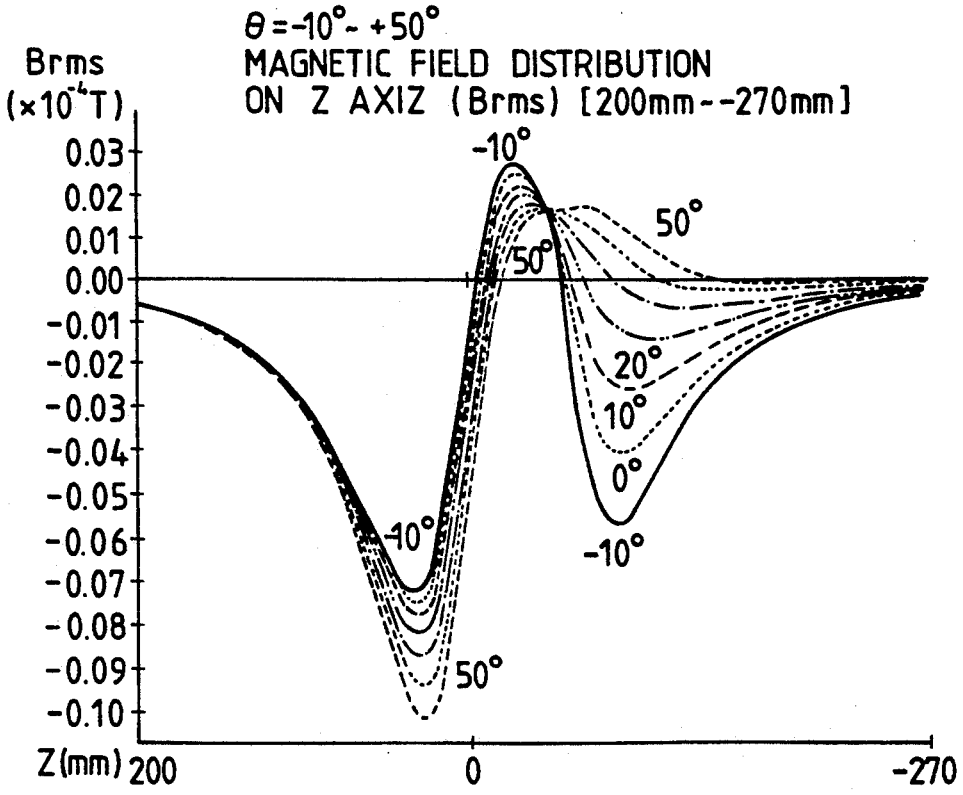
Figure 5A:
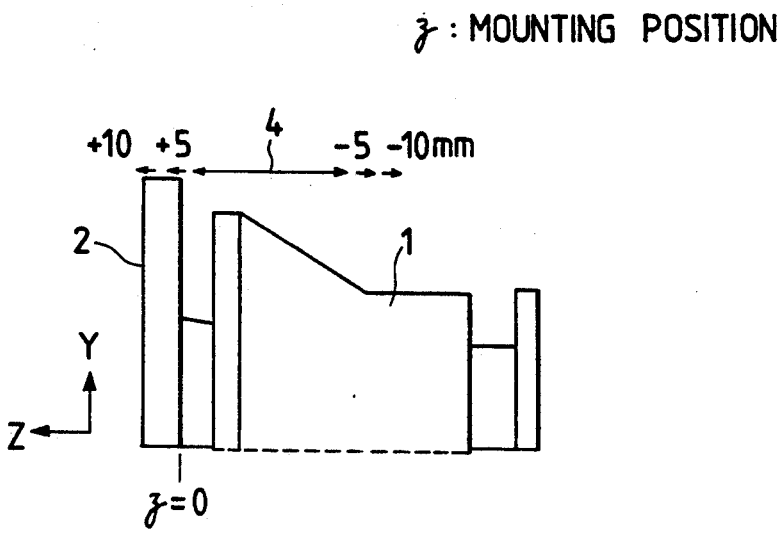
FIGS. 5(*a*) and 5(*b*) show a relation between the distribution of the cancelling field and a mounting position of the cancelling coil on a cathode ray tube.
Figure 5B:
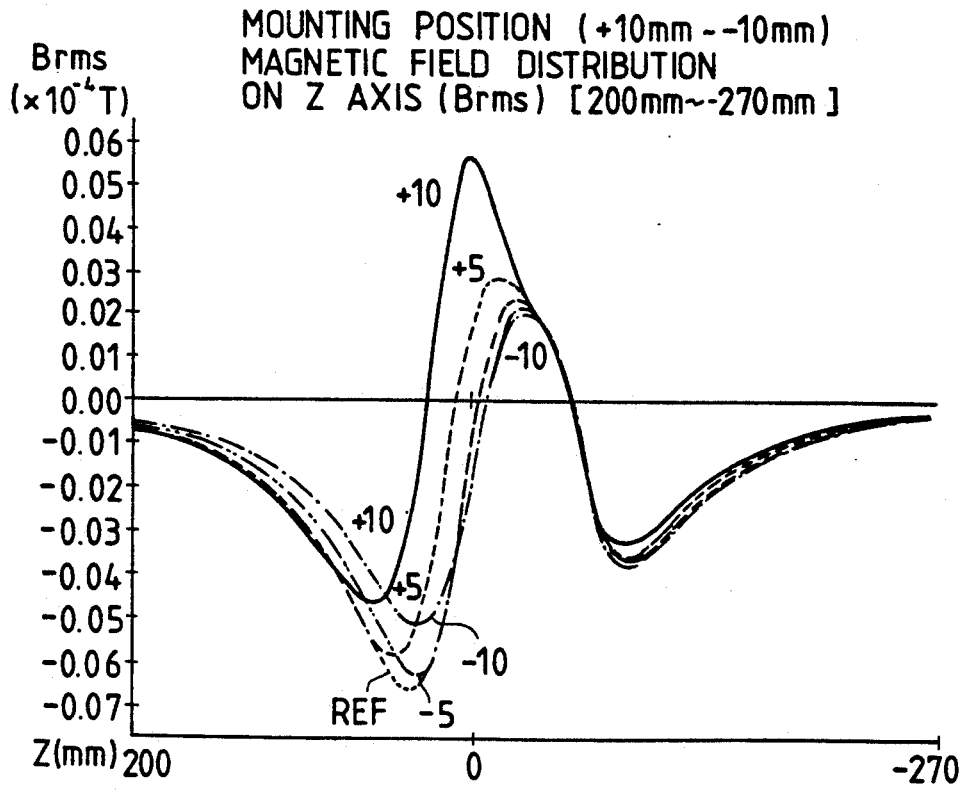
Figure 7:
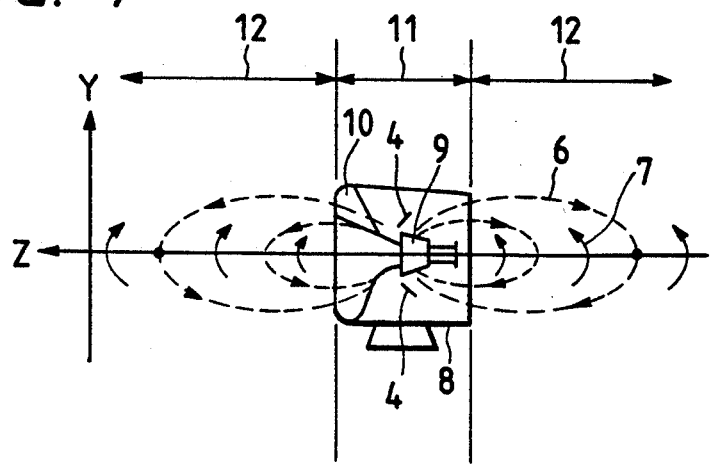
FIG. 7 illustrates undesired magnetic field in a conventional display device.

The mounting angle and the mounting position in Z direction of the loop coils 4 and 4' affect an amount of deviation of the deflection center of the horizontal deflection field when the cancelling field is applied. That is, an amount of mislanding depends upon the mounting angle and the mounting position of the loop coils. FIGS. 4 and 5 show distributions of cancelling field with the mounting angle and the mounting position being variables, respectively. The distributions shown in FIGS. 4(*a*) and (*b*) and 5(*a*) and (*b*) are plots of cancelling magnetic field strength measured on the tube axis within a region in which the electron beam is deflected horizontally and the cancelling field strength in the front and rear regions of the center of the deflection yoke is related to a position of the deflection center.

It is clear from FIGS. 4(*a*) and (*b*) that, when the cancelling coils 4 and 4' are inclined forwardly or opened backwardly by increasing the mounting angle $\theta$, the cancelling amount in the front portion of the deflection yoke is increased and that in the rear portion is reduced. Therefore, the horizontal deflection field in the front portion of the deflection region is cancelled considerably, resulting in that the deflection center of the electron beam is shifted rearwardly to the side of electron guns.

It is clear from FIGS. 5(*a*) and (*b*) that, when the mounting position of the loop coils and 4 and 4' are shifted while maintaining the mounting angle $\theta$ being 0, the ratio of cancelling amount between the front and rear portions is also changed. Further, plus magnetic field (magnetic field in the same direction as that of the horizontal deflection field) around the center portion is larger in absolute value and its center is shifted forwardly, when the loop coils are shifted forwardly. This means that it is possible to reduce a rearward shift of the deflection center of the horizontal deflection field. However, when the forward shift of the loop coils is too much, a distance thereof to the ferrite core 1 becomes too large, resulting in reduction of cancelling field generation efficiency. Therefore, there is a certain limitation of the shift amount of the loop coils. In this example, with the front end position Z of the cancelling coil Z=−2 mm being a reference, a practical upper limit of the shift is +10 mm. This position is obtained when the front ends of the loop coils are registered with the front end of the deflection yoke.

From the foregoing, it is clear that there are optimum mounting position and angle for the loop coils with which requirements of both the leak field correction and the reduction of mislanding are satisfied.

In this embodiment, it is sufficient to prepare and mount the loop coils such that they cover the area from the front end of the deflection yoke up to the center of the ferrite core at maximum in Z direction with width of each loop coil in X direction being arbitrary. In more detail, the bobbins 3 for the loop coils for a deflection yoke of, for example, a 14" color display deflection yoke have rectangular inner configuration each of 80 mm×26 mm. It is sufficient to mount the loop coils such that the front ends thereof are registered with the front end of the deflection yoke and their angles with respect to the tube axis are zero.

In such case, the amount of correction of leak magnetic field in both the front and rear portions of the deflection yoke are substantially equal. Therefore, in order to reduce leak field of the deflection yoke in the front portion, the amount of cancelling should be determined such that leak field in the front portion is less corrected while that in the rear portion is corrected much. FIGS. 6(*a*)–6(*c*) show the relation between an amount B1 of leak field and an amount B2 of cancelling field.

Figure 8A:
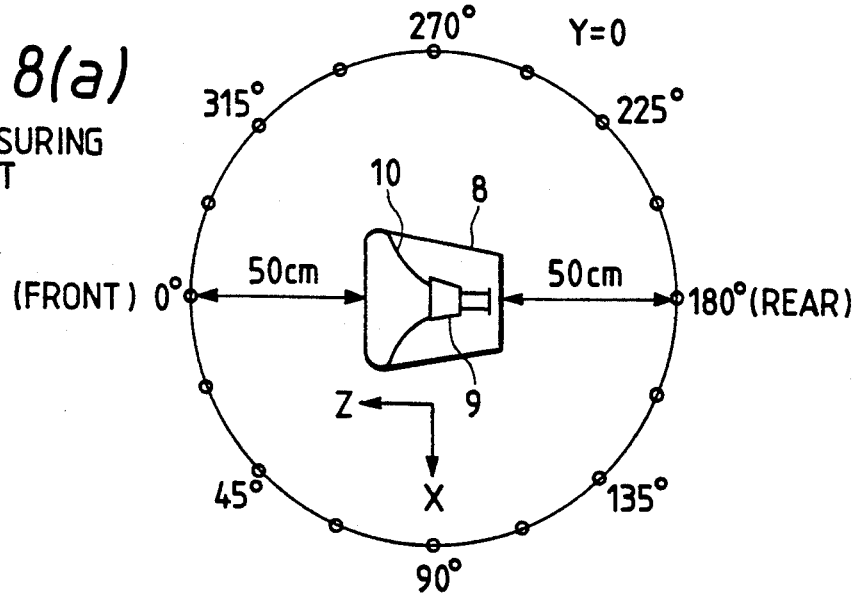
FIGS. 8(*a*) and 8(*b*) show a distribution of undesired magnetic field in the conventional display device.
Figure 8B:
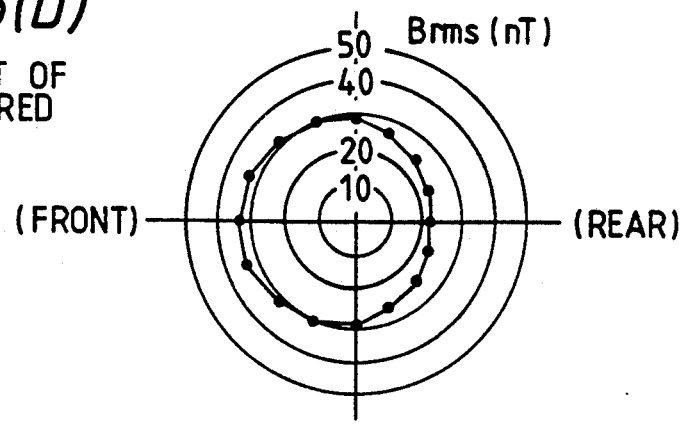
Figure 9:
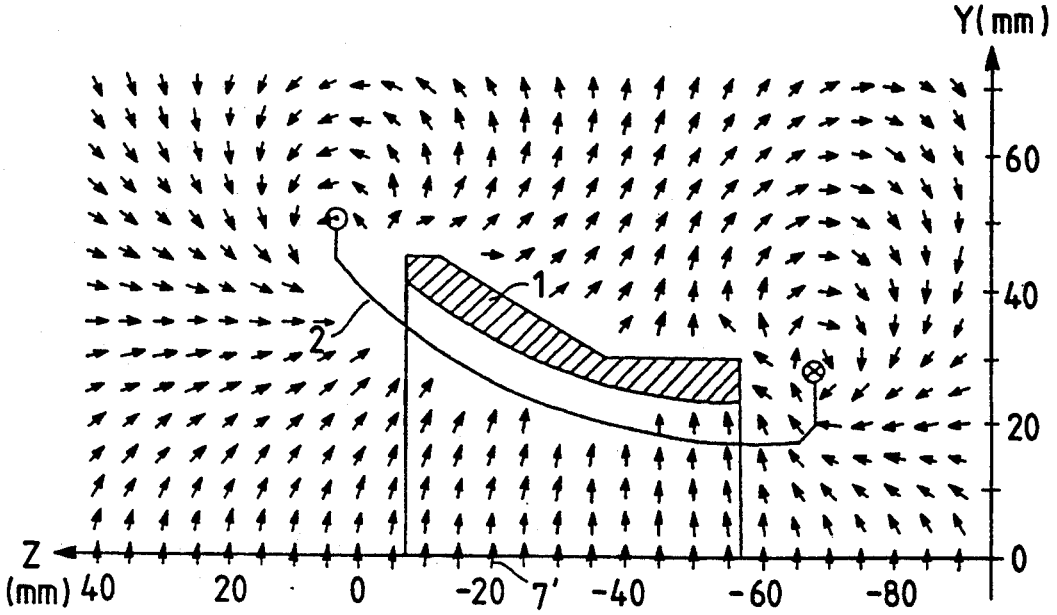
FIG. 9 is a vector diagram of deflection field of a deflection yoke.
Figure 10:
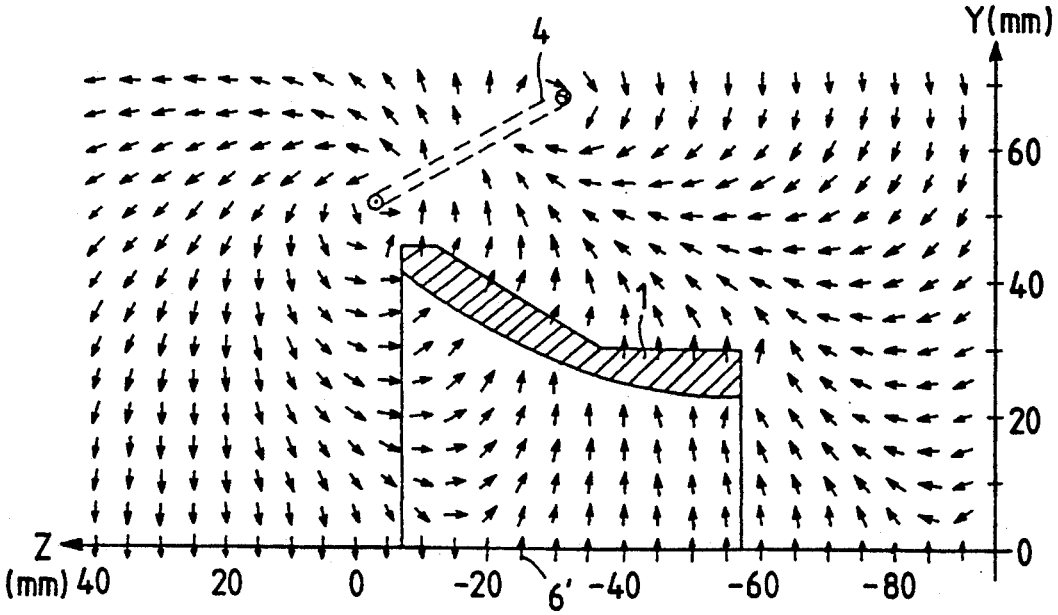
FIG. 10 is a vector diagram of a cancelling field in the conventional device.

Graphs in FIGS. 6(*a*) to 6(*c*) show the leak field, the cancelling field and the corrected magnetic field, respectively, with ordinate and abscissa being effective value of magnetic field and angular position at which magnetic field is measured, respectively. The measuring positions correspond to 9 points shown in FIG. 8 from the front to rear with different in angle by 22.5 degrees to each other.

In FIG. 6(*a*), leak field B1 from the deflection yoke itself is larger in the front portion and reduces toward the rear portion substantially monotoneously. As shown in FIG. 6(*b*), the loop coils generate a cancelling field B2 having substantially constant strength and cancel the leak field in the front and rear regions, resulting in a corrected field B1–B2 shown in FIG. 6(*c*). In order to minimize the residual leak field (B1–B2) after correction, the absolute value of the cancelling field is set by regulating the horizontal position of the loop coils such that correction is made less in the front region and much in the rear region.

As described hereinbefore, by providing the loop coils, it is possible to restrict the mislanding to a value less than 10 μm which raises practically no problem while reducing leak field below a desired limit.

Figure 13:
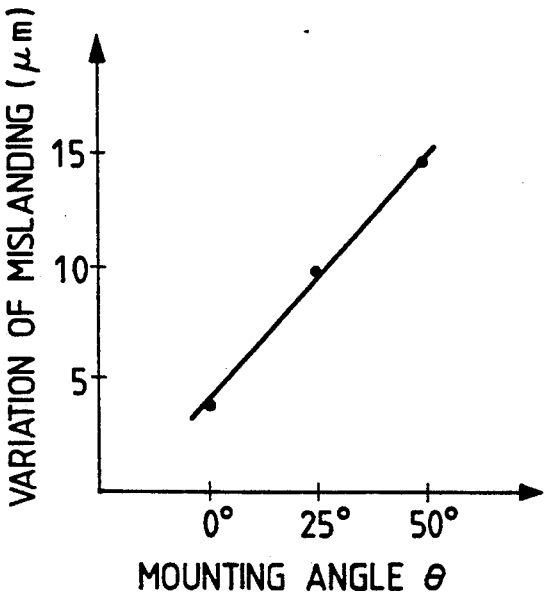
FIG. 13 shows a relation between mounting angle of cancelling loop coils and amount of mislanding in accordance with the present invention.

FIG. 13 shows the relation between the mounting angle of the cancelling loop coils and the amount of mislanding, when the present invention is applied to a deflection yoke of a 14" color display device. The size of each loop coil is 80 m×26 mm and its position is set by registering the front end thereof with the front end of the deflection yoke. As shown, when the mounting angle is varied from 0 degree through 25 degree to 50 degree, the amount of mislanding tends to increase.

Since the loop coils do not incline substantially, it is possible to make the vertical size of the deflection yoke compact. Further, since the loop coils are closer to the ferrite core compared with the conventional cancelling coils, the cancelling field can be generated efficiently.

Although, in this embodiment, the loop coils are rectangular, they may be oval with the same effect so long as the cancelling field distribution is regulated by regulating the mounting angle and mounting position.

Although the present invention has been described with reference to specific embodiments, this description is not meant to be construed in a limiting sense. Various modifications of the disclosed embodiments, as well as other embodiments of the present invention, will become apparent to persons skilled in the art upon reference to the description of the present invention. It is, therefore, contemplated that the appended claims will cover any modifications or embodiments as fall within the true scope of the present invention.

What is claimed is:

1. A deflection yoke for a cathode ray tube, comprising:

a deflection yoke body including horizontal deflection coil means for generating a horizontal deflection magnetic field, vertical deflection coil means for generating a vertical deflection magnetic field and a ferrite core; and an upper cancelling coil and a lower cancelling coil for cancelling an undesired magnetic field generated by said deflection yoke body, said upper and lower cancelling coils being arranged above and below said deflection yoke body, for generating a cancelling magnetic field for substantially cancelling undesired portions of the horizontal deflection magnetic field, said upper and lower cancelling coils being arranged between a front end of said horizontal deflection coil means and a center of said ferrite core and in parallel to an axis direction of said deflection yoke body, the undesired portions of the horizontal deflection magnetic field in a front region and a rear region of said deflection yoke body being under-corrected and over-corrected, respectively.

2. The deflection yoke claimed in claim 1, wherein said upper and lower cancelling coils are arranged at said front end.

3. A cathode ray tube display device, comprising:

a cathode ray tube;

a deflection yoke body including horizontal deflection coil means for generating a horizontal deflection magnetic field, vertical deflection coil means for generating a vertical deflection magnetic field and a ferrite core; and an upper cancelling coil and a lower cancelling coil for cancelling an undesired magnetic field generated by said deflection yoke body, said upper and lower cancelling coils being arranged above and below said deflection yoke body, for generating a cancelling magnetic field for substantially cancelling undesired portions of the horizontal deflection magnetic field, said upper and lower cancelling coils being arranged between a front end of said horizontal deflection coil means and a center of said ferrite core and in parallel to an axis direction of said deflection yoke body, the undesired portions of the horizontal deflection magnetic field in a front region and a rear region of said deflection yoke body being under-corrected and over-corrected, respectively.

4. The cathode ray tube display device claimed in claim 3, wherein said upper and lower cancelling coils are arranged at said front end.

* * * * *